US008276573B2

(12) United States Patent
Skell et al.

(10) Patent No.: US 8,276,573 B2
(45) Date of Patent: Oct. 2, 2012

(54) FAILURE PREVENTION IN PORTABLE TARGET THROWING MACHINES

(75) Inventors: Daniel G. Skell, Cedarburg, WI (US); Frederick Kruschka, Waukesha, WI (US); Thomas D. Tagliapietra, Glendale, WI (US); Brent Munsall, Fredonia, WI (US)

(73) Assignee: Electro-Pro, Inc., Cedarburg, WI (US)

( * ) Notice: Subject to any disclaimer, the term of this patent is extended or adjusted under 35 U.S.C. 154(b) by 980 days.

(21) Appl. No.: 12/324,392

(22) Filed: Nov. 26, 2008

(65) Prior Publication Data

US 2010/0126484 A1 May 27, 2010

(51) Int. Cl.
*F41J 9/18* (2006.01)

(52) U.S. Cl. ..... 124/8; 124/1; 124/4; 124/6; 124/7; 124/9; 124/54; 340/540

(58) Field of Classification Search ..... 124/1, 4, 124/54, 6–9; 340/540
See application file for complete search history.

(56) References Cited

U.S. PATENT DOCUMENTS 3,680,863 A * 8/1972 Wallace et al. ..... 273/362
3,722,495 A * 3/1973 Hansen ..... 124/9
3,739,373 A * 6/1973 Liming et al. ..... 340/309.8
3,923,033 A * 12/1975 Laporte et al. ..... 124/8
4,146,007 A * 3/1979 Alday et al. ..... 124/9
4,699,116 A * 10/1987 Freeland et al. ..... 124/7
4,706,641 A * 11/1987 Cote et al. ..... 124/8
4,889,346 A * 12/1989 Destry et al. ..... 273/406
5,359,576 A * 10/1994 Bunner et al. ..... 367/197
5,470,078 A * 11/1995 Conlan ..... 273/317
5,529,310 A * 6/1996 Hazard et al. ..... 273/362
5,937,839 A * 8/1999 Nilsson et al. ..... 124/8
6,159,112 A * 12/2000 Ciluffo et al. ..... 473/451
6,588,410 B1 * 7/2003 Graber ..... 124/8
7,263,986 B2 * 9/2007 Lovell ..... 124/9
8,151,726 B2 * 4/2012 Cossaboom ..... 116/303
2007/0023022 A1 * 2/2007 Lentz ..... 124/8

* cited by examiner

*Primary Examiner* — Gene Kim
*Assistant Examiner* — Alexander Niconovich
(74) *Attorney, Agent, or Firm* — Ziolkowski Patent Solutions Group, SC

(57) ABSTRACT

A circuit module for preventing component failure in portable target throwing machines, the circuit module comprising a microcontroller coupled to a power source and a motor, wherein the microcontroller is configured to count a number of clay target throwing cycles and a run time of the motor. The circuit module also comprises a relay coupled to the microcontroller and the motor, wherein the relay is configured to open and interrupt power supply to the motor when at least one of the number of clay target throwing cycles and the run time of the motor exceeds a predetermined threshold.

19 Claims, 4 Drawing Sheets

FAILURE PREVENTION IN PORTABLE TARGET THROWING MACHINES

BACKGROUND OF THE INVENTION

The present invention relates generally to portable target throwing machines for propelling clay targets, commonly referred to as trap or skeet machines, and is more specifically directed to the prevention of repeated target discharge when a component fails within the portable target throwing machine.

Target throwing machines used for throwing clay targets during shooting practices and competitions are available in a wide variety of designs having varying complexities. Conventional target throwing machines generally include a frame portion having a planar throwing table on which clay targets may be positioned. A spring biased throwing arm may be turned about a vertical axle by a motor such that the arm is in contact with at least one clay target while the spring is loaded. When the clay target is to be discharged, the arm is released and permitted to rotate quickly about the axle due to the loaded spring. In this way, the clay target is propelled from the throwing table, acting as a moving target for the shooter. To increase the difficulty for the shooter, target throwing machines are often equipped with various mechanisms to alter the direction of the throw both in the horizontal and the vertical planes.

The use of target throwing machines often occurs in large, unobstructed areas, where shooters are able to safely fire their weapons at the projected targets. There are two basic types of target throwing machines—stationary and portable. In rural areas where land may have multiple uses, it is advantageous to utilize portable units. Also, since these areas are generally far from buildings and other covered structures, it is sometimes desirable to leave the portable target throwing machines outdoors for several days at a time. Such portable target throwing machines are often mounted on wheeled carts and are powered by conventional 12 Volt batteries, enabling the target throwing machines to be transported to the position desired.

FIGS. 1 and 2 illustrate an example of a conventional portable target throwing machine. FIG. 1 is a perspective view of the front of portable target throwing machine 100. Target throwing machine 100 is rigidly mounted at bottom plate 110 to, for example, a wheeled cart (not shown). Motor 114 is mounted to bottom plate 110 and is operable to drive various components to alter the angle and/or pitch of frame 120, thereby allowing the target throwing machine to propel clay targets in multiple directions as chosen by the user. A plurality of clay targets are stored in a stacked configuration in multiple storage magazines 123, whereby the clay targets are delivered to throwing arm 175 in a consecutive fashion as storage magazines 123 are rotated about round sliding plate 129. The throwing arm 175 is then engaged, and when a signal to activate a clay target discharge is received, the biasing force of throwing spring 170 causes the throwing arm 175 to rapidly accelerate and propel at least one clay target. The signal to activate a clay target discharge can come from manual or voice commands delivered by a user, whereby this signal is then sent to electronics within the portable target throwing machine 100 that control the overall operation of the device.

FIG. 2 is another perspective view of conventional portable target throwing machine 100. FIG. 2, like FIG. 1, illustrates bottom plate 110, frame 120, storage magazines 123, and round sliding plate 129. Also shown is a main motor 132 and gear box 133. Main motor 132 and gear box 133 act in concert to enable rotation of the storage magazines 123 about round sliding plate 123 such that the throwing arm 175 can be automatically reloaded with clay targets throughout a target shooting session. Further, main motor 132 and gear box 133 are also coupled to components that enable throwing spring 170 to be energized, which thereby causes the throwing arm 175 to rapidly accelerate and discharge at least one clay target.

As shown in FIGS. 1 and 2, a majority of the components of a conventional portable target throwing machine are generally not protected by sealed and watertight enclosures. While these enclosures are not generally necessary when the portable target throwing machines are only operated under optimal weather conditions and are then returned to sheltered locations, such is not always the case. Oftentimes the target throwing machines are used during inclement weather, such as rain or snow, or are left unattended in the field for days, if not weeks. As the components are not protected from the elements, many are susceptible to failure under prolonged exposure, particularly the components of the electrical system within the target throwing machine. Costly maintenance and/or repair expenses are often incurred by the users due to these component failures.

One such component failure that often occurs when the portable target throwing machines are left unattended is a failure of the electrical switch or switches that control discharge of the clay targets. When the switch or switches short out or stick in a discharge mode, the target throwing machine will continue to propel clay targets, even when no user commands are received by the controls. As the clay target storage capacity of many target throwing machines is upward of 350-400 targets, many targets are wasted due to this unintentional discharge when the target throwing machine is unattended. Further, even when all of the remaining clay targets are discharged, the target throwing machine can still continue to operate as if targets are present. This continued operation not only drains the battery that powers the target throwing machine, it can also ruin the drive motor. That is, as the stored energy is depleted, the battery may not have ample power to overcome the spring pressure to fire the throwing arm. As the motor or motors begin to draw more amperage to overcome the spring pressure, which the battery cannot supply, the motor eventually burns itself out by continuing to draw more amps to run. Obviously, burning out a motor necessitates even more costly repairs.

It would therefore be desirable to have an apparatus and method capable of preventing the unwanted discharge of clay targets and subsequent component failure in portable target throwing machines.

BRIEF DESCRIPTION OF THE INVENTION

The present invention provides a circuit module for preventing component failure in portable target throwing machines, the circuit module comprising a microcontroller coupled to a power source and a motor, wherein the microcontroller is configured to count a number of clay target throwing cycles and a run time of the motor. The circuit module also comprises a relay coupled to the microcontroller and the motor, wherein the relay is configured to open and interrupt power supply to the motor when at least one of the number of clay target throwing cycles and the run time of the motor exceeds a predetermined threshold.

In accordance with another aspect of the invention, a method of preventing component failure in a portable target throwing machine is shown, the method comprising detecting the activation of a switch to propel at least one clay target, and counting, through the use of a microcontroller, a number of target throwing cycles initiated after detecting the switch activation. The method also comprises counting, through the use of a microcontroller, a run time of a motor, and interrupting a power supply to the motor if a predetermined number of target throwing cycles or a predetermined run time of a motor exceeds a threshold.

In accordance with another aspect of the invention, a portable target throwing machine is shown, the portable target throwing machine comprising a storage device configured to store a plurality of clay targets, a throwing arm coupled to a throwing spring and operable to propel at least one clay target, a motor configured to drive the throwing arm into a throwing position, a power supply, and a circuit module coupled to the motor and configured to interrupt power supply to the motor when a fault condition is detected by a microcontroller device within the circuit module.

Various other features and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
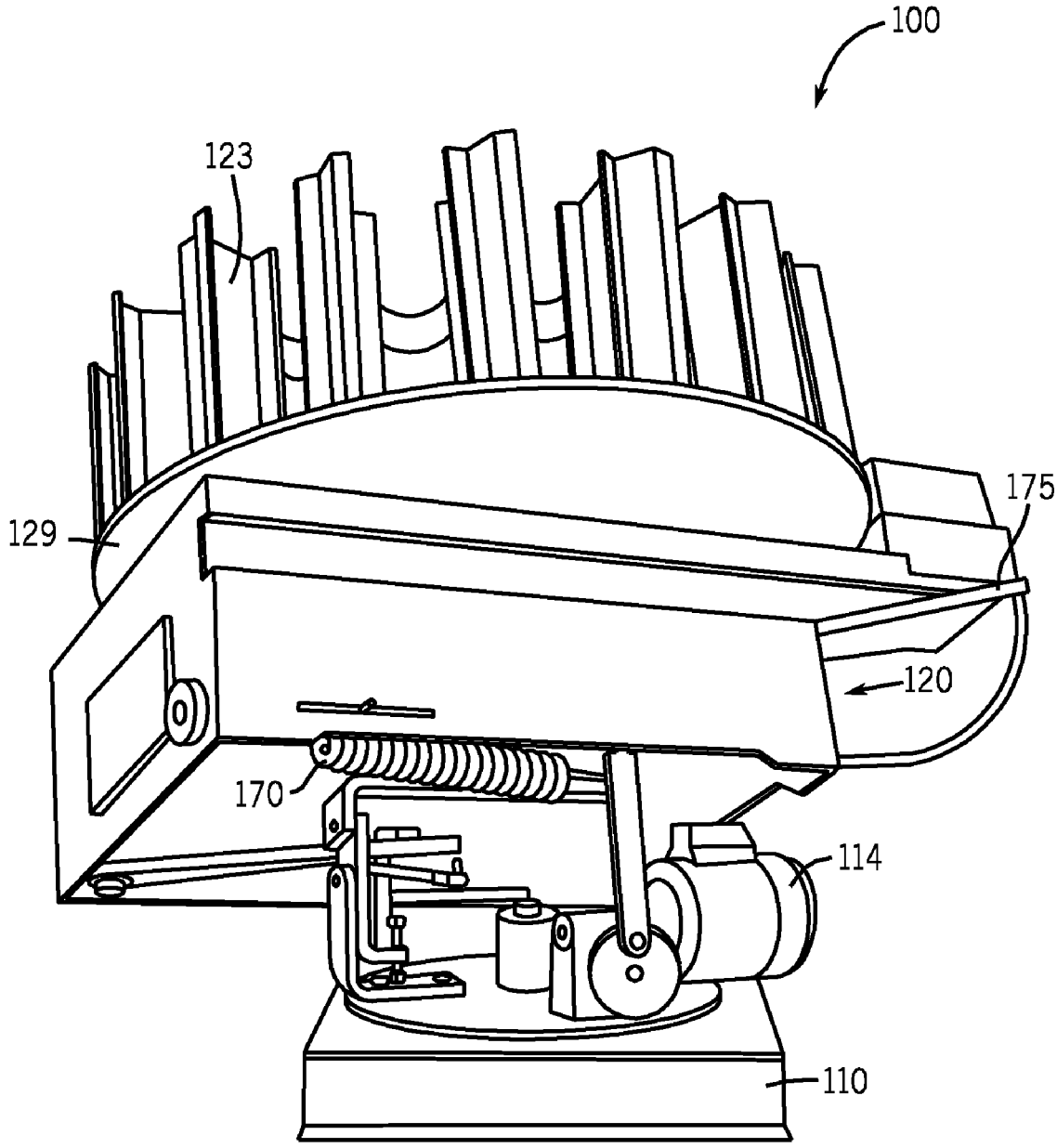
FIG. 1 (PRIOR ART)
FIG. 1 is a perspective view of a conventional portable target throwing machine.
Figure 2:
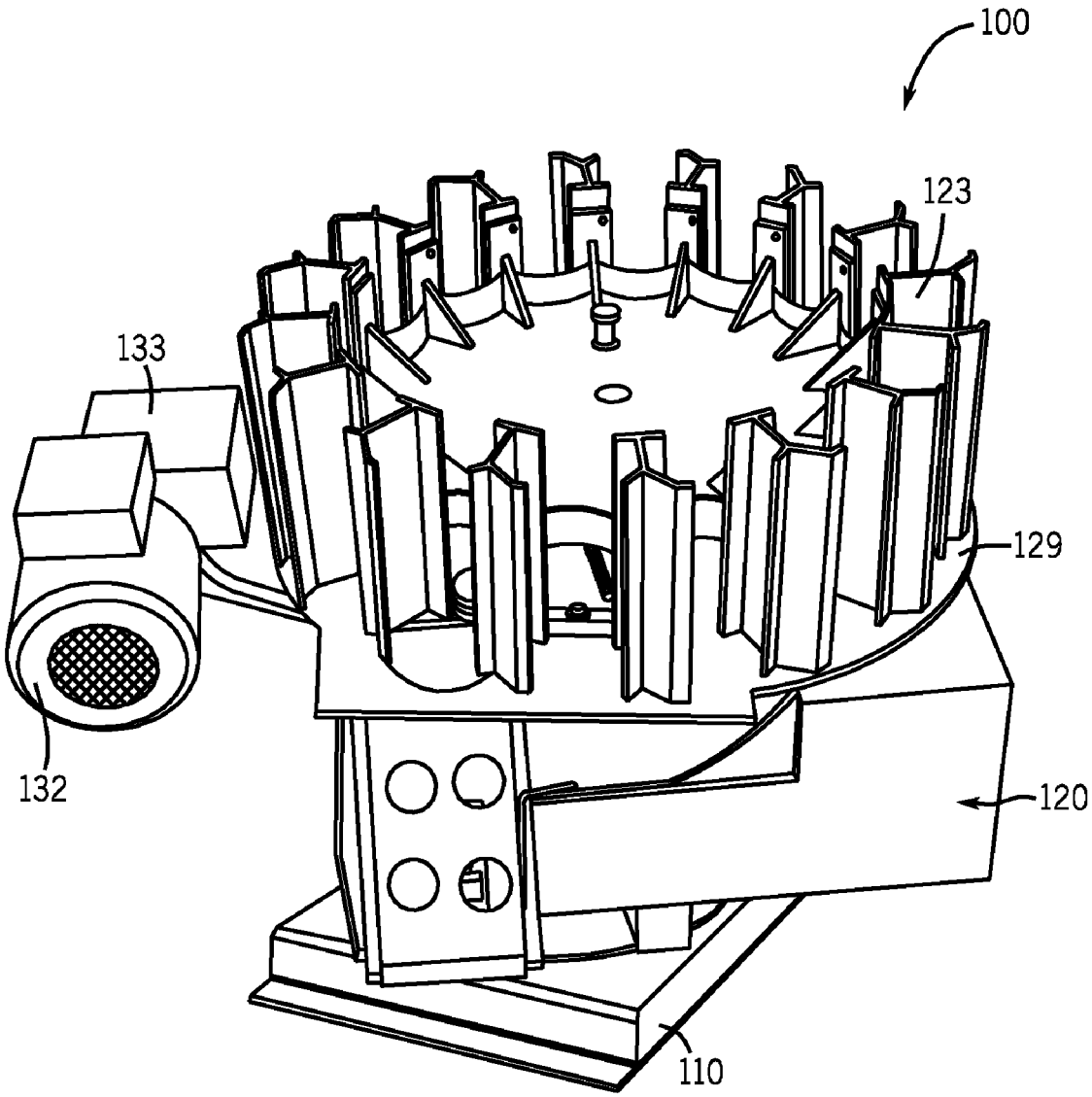
FIG. 2 (PRIOR ART)
FIG. 2 is another perspective view of a conventional portable target throwing machine.
Figure 3:
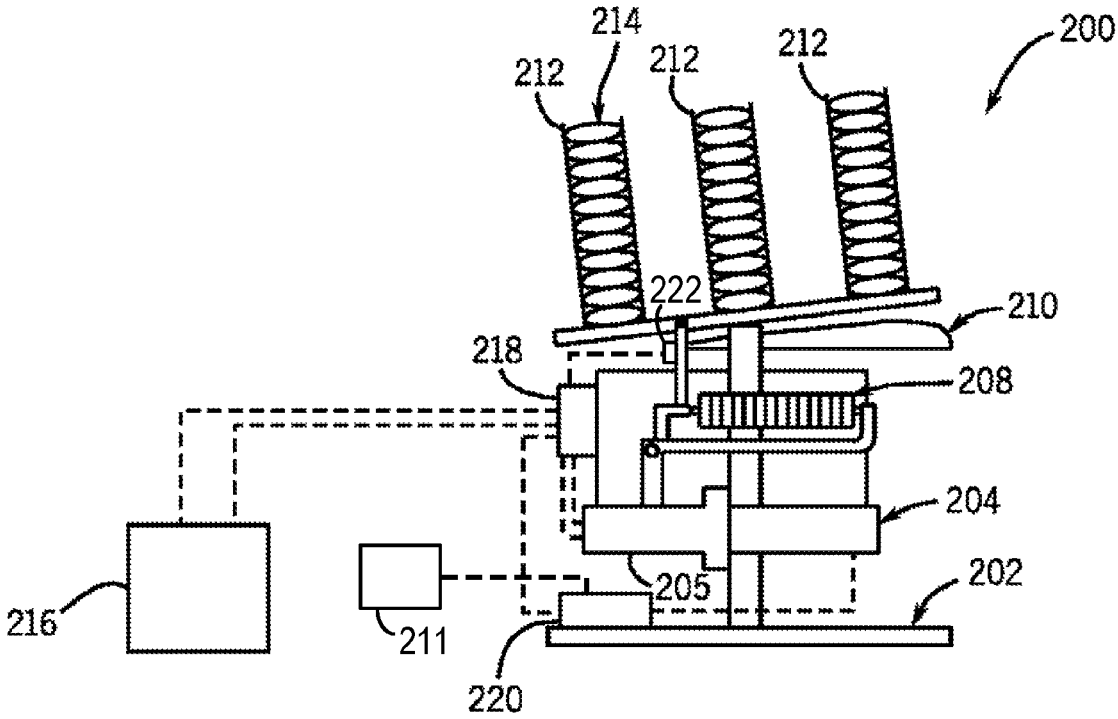
FIG. 3 is a perspective view of a portable target throwing machine according an embodiment of the present invention.

FIG. 3 illustrates a portable target throwing machine according to the present invention. In the embodiment of FIG. 3, a portable target throwing machine 200 comprises many of the same components as the conventional portable target throwing machine set forth in FIGS. 1 and 2. That is, portable target throwing machine 200 comprises a base 202, wherein base 202 is configured to be rigidly mounted to, for example, a wheeled cart (not shown). Such a configuration enables optimal portability of the system and allows the portable target throwing machine 200 to be placed in any suitable area chosen by a user. Further, motor 204 and gear box 205 are operable to energize a throwing spring 208 such that throwing spring 208 provides a biasing force on throwing arm 210. When a user provides a trigger signal through either a physical or voice activated switch 211, the force on throwing spring 208 is released and throwing arm 210 is quickly rotated so as to propel at least one clay target 214. A plurality of clay targets 214 are stored in a plurality of storage magazines 212 such that throwing arm 210 can be continuously reloaded between target propulsions, thereby preventing the user from having to constantly reload the portable target throwing machine 200. The plurality storage magazines 212 are often capable of holding upwards of 350-400 clay targets, and thus the need for manual reloading of portable target throwing machine 200 by the user should be very infrequent.

Referring still to FIG. 3, a power supply 216 is shown connected to the portable target throwing machine 200, wherein power supply 216 provides power to all electrical components in the machine, including motor 204. Power supply 216 can be, for example, a conventional 12 Volt battery, but is not limited to such. A junction box 218 provides a housing for the connections between the electrical components of portable trap machine 200, such as motor 204, and the power supply 216. This configuration prevents wired connections between various electronic components of the portable target throwing machine 200 and the power supply 216 from interfering with the operation of the portable target throwing machine 200.

As discussed above, due to the exposure to various weather conditions and other elements while left in the field for extended periods of time, the electrical components of a portable target throwing machine can malfunction or fail, requiring costly replacement or maintenance in a variety of forms. Portable target throwing machine 200, however, includes a circuit module 220 that is configured to prevent further costly failures from occurring. Circuit module 220 is shown in FIG. 3 to be mounted to base 202 of portable target throwing machine 200, but can be mounted in any location on or near portable target throwing machine 200. Circuit module 220 is electrically coupled to motor 204 and junction box 218. Through connections in junction box 218, the circuit module 220 is further electrically connected to the power supply 216 and the electrical switch or switches operable to receive a trigger signal from the user. Preferably, circuit module 220 is interchangeable and portable, and thus can be integrated with any portable target throwing machine that relies upon various electrical components for operation. Details of the operation of circuit module 220 are described in further detail below.

Figure 4:
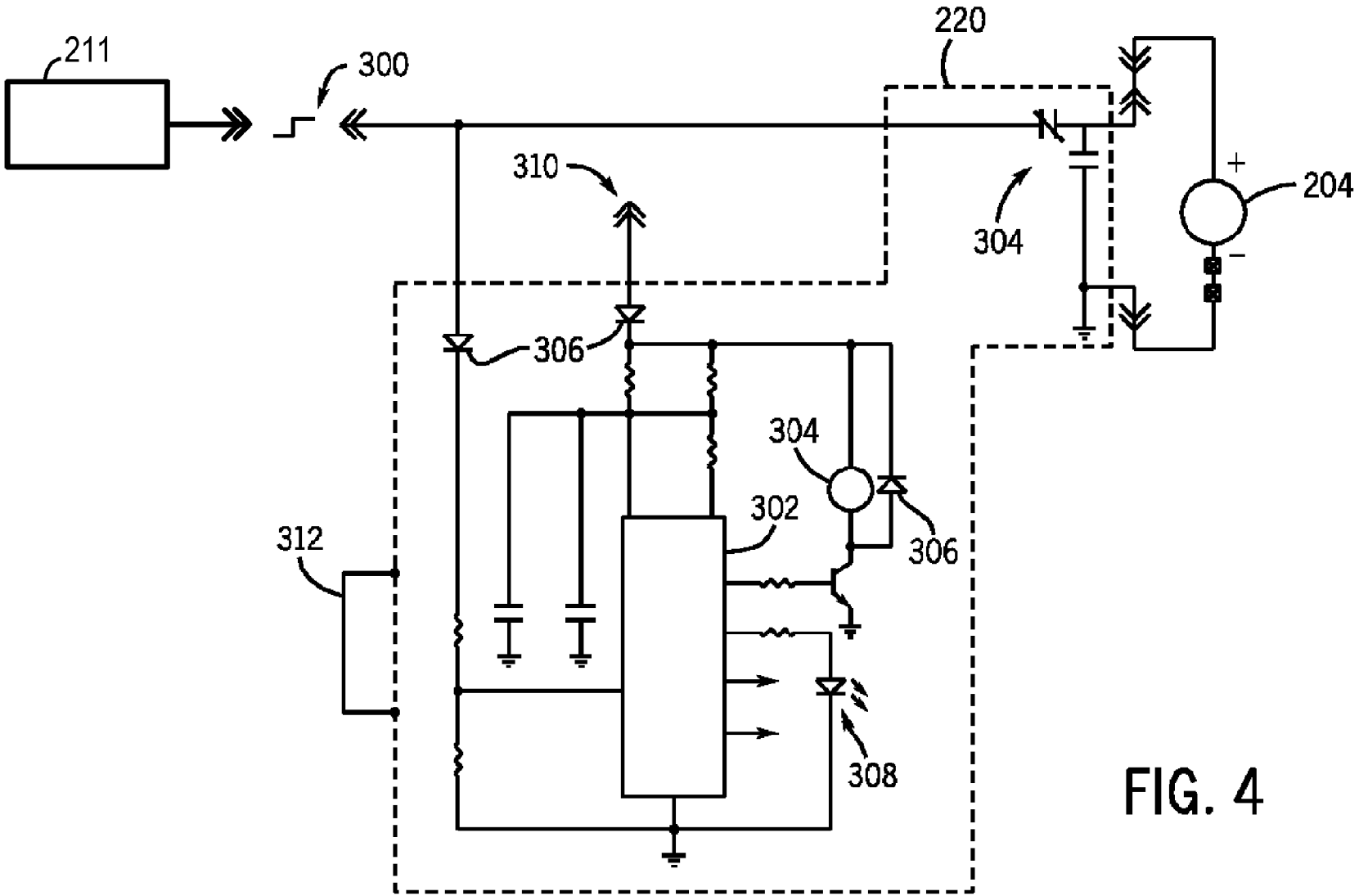
FIG. 4 is a schematic view of a circuit module according to an embodiment of the present invention.

Referring now to FIG. 4, a more detailed view of circuit module 220 in accordance with an embodiment of the invention is shown. Circuit module 220 is electrically coupled to motor 204 and is configured to receive trigger signals 300 from a user through either a physical or voice activated switch 211. The trigger signals 300 sent by the physical or voice activated switch are also relayed to motor 204, such that the motor 204 is operated to assist in propelling one or more clay targets upon receipt of a trigger signal. Circuit module 220 includes a microcontroller 302, which also receives the trigger signals 300. Microcontroller 302 is programmed to count the number of throwing cycles, i.e., the number of times motor 204 is activated to propel at least one clay target after the receipt of each trigger signal. Alternatively, the number of clay targets propelled, each equating to a single throwing cycle, can be counted by sensors 222 (FIG. 3) located on the portable clay target device. A predetermined threshold of throwing cycles allowable after each trigger signal (e.g., 3 to 5 throwing cycles) is further programmed into microcontroller 302. If the number of throwing cycles activated after each trigger signal exceeds the predetermined threshold, circuit module 220 acts to disable the motor 204 such that additional clay targets are prevented from being propelled from the portable target throwing machine.

Again, in the event that microcontroller 302 detects that the predetermined threshold has been exceeded, circuit module 220 acts to interrupt the power supply to the motor 204 such that further propulsion of clay targets is prevented. Specifically, microcontroller 302 sends a signal to a relay coil 304 when the threshold is exceeded, which opens relay coil 304 such that power supply to motor 204 is interrupted. A plurality of free-wheeling diodes 306 are also placed within circuit module 220 to absorb any inductive surge that may occur when the relay coil 304 is opened, thereby protecting the electrical components of circuit module 220 from possible damage or failure. Additionally, microcontroller 302 sends a signal to at least one light emitting diode (LED) 308 located on circuit module 220, which provides a visible indication to a user that an error condition has occurred.

When power supply to the motor 204 is interrupted, operation of the portable target throwing machine is disabled. In order to resume operation of the portable target machine, the user must manually reset the device using existing on/off switch 310. On/off switch 310 can be a three-pole switch, as is used in conventional portable target throwing machines. In other words, on/off switch 310 can be set to arm, disarm, or turn off the portable target throwing machine. On/off switch 310 is coupled to the microcontroller 302 of circuit module 220, allowing the circuit module 220 to be reset when the user manually places on/off switch 310 in an arm or disarm mode after an error condition has occurred. Only after manual reset of on/off switch 310 can operation of the portable target throwing machine resume. In this way, the portable target throwing machine is prevented from propelling clay targets after an error condition is detected, thereby saving a plurality of clay targets from being unnecessarily propelled. Additionally, the power supply is prevented from being depleted due to inadvertent operation of the portable target throwing machine.

While the example set forth above defines the predetermined threshold stored in the microcontroller 302 as being defined by the number of throwing cycles completed after each trigger signal, the invention is not limited as such. For example, microcontroller 302 can also be programmed to determine the run time of motor 204 after each trigger signal is received. If the run time of motor 204 exceeds a predetermined run time threshold, microcontroller 302 can act to interrupt power supply to motor 204 so as to disable operation of the portable target throwing machine. The circuit module 220 may further be configured to enable the user to manually adjust the motor run time threshold according to their requirements. For example, a device 312, such as a potentiometer, can be mounted to the circuit module 220 and be in communication with microcontroller 302 such that user preferences can be manually adjusted. Microcontroller 302 can also be configured to monitor both the number of throwing cycles and the motor run time after each trigger signal and interrupt power supply to motor 204 if either condition exceeds a predetermined threshold. Accordingly, circuit module 220 acts to prevent unwanted or unprovoked operation of the portable target throwing machine, which can lead to costly component repair or replacement.

By incorporating circuit module 220 into a portable target throwing machine, the unintentional and wasteful discharge of a plurality of clay targets can be greatly reduced, if not entirely eliminated. Likewise, the battery or other device configured to provide power to the portable target throwing machine will not be substantially depleted and thus motor failure or other component failures due to excessive amperage draw can be avoided. If users of the portable target throwing machine leave the portable target throwing machines unattended in the field, circuit module 220 prevents minor component failures, such as switch failures, from causing more serious and more costly failures to larger components in the machine.

Therefore, in accordance with an embodiment of the present invention, a circuit module is shown for preventing component failure in portable target throwing machines, the circuit module comprising a microcontroller coupled to a power source and a motor, wherein the microcontroller is configured to count a number of clay target throwing cycles and a run time of the motor. The circuit module also comprises a relay coupled to the microcontroller and the motor, wherein the relay is configured to open and interrupt power supply to the motor when at least one of the number of clay target throwing cycles and the run time of the motor exceeds a predetermined threshold.

In accordance with another aspect of the invention, a method of preventing component failure in a portable target throwing machine is shown, the method comprising detecting the activation of a switch to propel at least one clay target, and counting, through the use of a microcontroller, a number of target throwing cycles initiated after detecting the switch activation. The method also comprises counting, through the use of a microcontroller, a run time of a motor, and interrupting a power supply to the motor if a predetermined number of target throwing cycles or a predetermined run time of a motor exceeds a threshold.

In accordance with another aspect of the invention, a portable target throwing machine is shown, the portable target throwing machine comprising a storage device configured to store a plurality of clay targets, a throwing arm coupled to a throwing spring and operable to propel at least one clay target, a motor configured to drive the throwing arm into a throwing position, a power supply, and a circuit module coupled to the motor and configured to interrupt power supply to the motor when a fault condition is detected by a microcontroller device within the circuit module.

The present invention has been described in terms of the preferred embodiment, and it is recognized that equivalents, alternatives, and modifications, aside from those expressly stated, are possible and within the scope of the appending claims.

What is claimed is:

1. A circuit module for preventing component failure in a portable target throwing machine, the circuit module comprising:

a microcontroller coupled to a power source and a motor; and a relay coupled to the microcontroller and the motor, wherein the relay is configured to selectively open and interrupt power supply to the motor;

wherein the microcontroller is configured to:

detect activation of a trigger switch by a user that causes at least one clay target to be propelled;

count at least one of a number of clay target throwing cycles and a run time of the motor after the trigger switch is activated by the user;

compare at least one of the number of clay target throwing cycles and the run time of the motor to a corresponding predetermined threshold;

determine that a failure in the trigger switch has occurred if the at least one of the number of clay target throwing cycles and the run time of the motor exceeds its corresponding predetermined threshold; and cause the relay to open and interrupt power supply to the motor responsive to determination of a trigger switch failure.

2. The circuit module of claim 1 wherein the circuit module is removably integrated with the portable target throwing machine, the portable target throwing machine further comprising:

a storage device configured to store a plurality of clay targets;

a throwing arm coupled to a throwing spring and operable to propel at least one clay target;

a motor configured to drive the throwing arm into a throwing position; and a power source.

3. The circuit module of claim 1 wherein a power switch manually operable by the user is coupled to the circuit module to enable a power reset after the power supply to the motor is interrupted.

4. The circuit module of claim 1 wherein the microcontroller is configured to count at least one of the number of clay target throwing cycles and the run time of the motor after the trigger switch is activated by the user.

5. The circuit module of claim 1 further comprising a device configured to enable user adjustment to the one of the number of clay target throwing cycles and the motor run time threshold.

6. The circuit module of claim 1 further comprising a light emitting diode (LED) coupled to the microcontroller and configured to illuminate when the relay is opened to interrupt power supply to the motor.

7. A method of preventing component failure in a portable target throwing machine, the method comprising:

detecting the activation of a switch in the portable target throwing machine, with the activation of the switch causing the portable target throwing machine to propel at least one clay target;

detecting a failure of the switch; and interrupting a power supply to a motor in the portable target throwing machine upon detection of a switch failure;

wherein detecting the failure of the switch comprises:

counting, through the use of a microcontroller, a number of target throwing cycles initiated after detecting the switch activation;

counting, through the use of a microcontroller, a run time of a the motor; and determining a switch failure if a predetermined number of target throwing cycles or a predetermined run time of a motor exceeds a threshold.

8. The method of claim 7 wherein the run time threshold of the motor can be adjusted by a user.

9. The method of claim 7 wherein the target throwing cycle threshold is a range of 3 to 5 target throwing cycles.

10. The method of claim 7 wherein the number of target throwing cycles is determined by at least one sensor configured to sense the number of targets propelled by the portable trap machine.

11. A portable target throwing machine comprising:

a storage device configured to store a plurality of clay targets;

a throwing arm coupled to a throwing spring and operable to propel at least one clay target;

a motor configured to drive the throwing arm into a throwing position;

a power supply; and a circuit module coupled to the motor and configured to interrupt the power supply to the motor when a fault condition is detected by a microcontroller device within the circuit module, the fault condition comprising a failure of an interface device triggered by a user to propel at least one clay target;

wherein, in detecting the failure of the interface device, the microcontroller device is configured to:

count a number of target throwing cycles initiated after triggering of the interface device;

count a run time of the motor after triggering of the interface device; and determine that a switch failure has occurred if a predetermined number of target throwing cycles or a predetermined run time of the motor exceeds a threshold.

12. The portable target throwing machine of claim 11 wherein the microcontroller device counts the number of target throwing cycles performed after each trigger operation by a user and interrupts the power supply to the motor if the number of target throwing cycles exceeds a predetermined threshold.

13. The portable target throwing machine of claim 12 wherein the predetermined threshold is a range of 3 to 5 target throwing cycles.

14. The portable target throwing machine of claim 12 wherein the number of throwing cycles is determined by at least one sensor operable to count the number of clay targets propelled after each trigger operation by a user.

15. The portable target throwing machine of claim 11 wherein the microcontroller device counts the run time of the motor after each trigger operation by a user and interrupts the power supply to the motor if the run time of the motor exceeds a predetermined threshold.

16. The portable target throwing machine of claim 15 wherein the circuit module further comprises a potentiometer configured to enable user adjustment of the motor run time threshold.

17. The portable target throwing machine of claim 11 wherein the circuit module is removably integrated with the portable trap machine.

18. The portable target throwing machine of claim 11 wherein the portable trap machine is powered by a 12 Volt battery.

19. The portable target throwing machine of claim 11 further comprising a power switch operable by the user to reset the portable trap machine after the power supply is interrupted.

* * * * *

UNITED STATES PATENT AND TRADEMARK OFFICE

CERTIFICATE OF CORRECTION

PATENT NO. : 8,276,573 B2
APPLICATION NO. : 12/324392
DATED : October 2, 2012
INVENTOR(S) : Skell et al.

It is certified that error appears in the above-identified patent and that said Letters Patent is hereby corrected as shown below:

Title Page, Item (75), Inventors, change "Munsall" to -- Munsell --.

Col. 7, line 32 (Claim 7), delete "time of a the" and
substitute therefore -- time of the --.

Signed and Sealed this
Thirteenth Day of November, 2012

David J. Kappos

David J. Kappos
*Director of the United States Patent and Trademark Office*